US009375772B2

(12) United States Patent
Chen

(10) Patent No.: US 9,375,772 B2
(45) Date of Patent: Jun. 28, 2016

(54) COMPRESSED GAS CARTRIDGE AND METHOD FOR MAKING SAME

(71) Applicant: Raylin Chen, Taoyuan (TW)

(72) Inventor: Raylin Chen, Taoyuan (TW)

(73) Assignee: Illinois Tool Works Inc., Glenview, IL (US)

( * ) Notice: Subject to any disclaimer, the term of this patent is extended or adjusted under 35 U.S.C. 154(b) by 49 days.

(21) Appl. No.: 13/624,734

(22) Filed: Sep. 21, 2012

(65) Prior Publication Data

US 2014/0083874 A1 Mar. 27, 2014

(51) Int. Cl.

| | |
|---|---|
| ***B21D 21/00*** | (2006.01) |
| ***B21D 5/00*** | (2006.01) |
| ***B21D 22/28*** | (2006.01) |
| ***B21D 51/24*** | (2006.01) |
| ***B21D 51/26*** | (2006.01) |
| ***B65D 1/02*** | (2006.01) |
| ***B21D 37/16*** | (2006.01) |
| ***B21D 41/04*** | (2006.01) |

(52) U.S. Cl.

CPC *B21D 5/00* (2013.01); *B21D 22/28* (2013.01); *B21D 37/16* (2013.01); *B21D 41/04* (2013.01); *B21D 51/24* (2013.01); *B21D 51/2638* (2013.01); *B65D 1/02* (2013.01)

(58) Field of Classification Search

CPC ..... B21D 5/00; B21D 41/04; B21D 37/16; B21D 51/2638; B21D 22/28; B21D 51/24; B65D 1/02

USPC ..... 29/890.053; 72/347–349

See application file for complete search history.

(56) References Cited

U.S. PATENT DOCUMENTS

| | | | | | |
|---|---|---|---|---|---|
| 1,059,212 | A | * | 4/1913 | Ross | 86/55 |
| 2,384,810 | A | * | 9/1945 | Calleson et al. | 220/658 |
| 3,022,567 | A | * | 2/1962 | Lyon | 86/56 |
| 3,614,816 | A | * | 10/1971 | Meyhmuller | 86/19.5 |
| 4,493,201 | A | * | 1/1985 | Schmidt | 72/349 |
| 4,599,886 | A | * | 7/1986 | Brown | 72/349 |
| 4,753,364 | A | * | 6/1988 | Stoffel et al. | 220/658 |
| 4,962,659 | A | * | 10/1990 | Imazu et al. | 72/349 |

FOREIGN PATENT DOCUMENTS

| | | |
|---|---|---|
| EP | 1882535 A1 | 1/2008 |
| EP | 1914026 A1 | 4/2008 |

* cited by examiner

*Primary Examiner* — Jacob Cigna

(74) *Attorney, Agent, or Firm* — Dale F. Regelman; Quarles & Brady LLP

(57) ABSTRACT

A method to form a disposable compressed gas cartridge, wherein the method provides a steel sheet, and using sequentially (N) progressively longer dies forms from the steel sheet a vessel comprising a cylindrical wall, a closed end, and an open end, wherein the cylindrical wall comprises a body diameter, and wherein (N) is greater than equal to 5. The method then heats a first portion of the vessel at an annealing temperature, wherein that first portion includes the open end and a portion of the cylindrical wall adjacent the open end. The method then uses sequentially (M) tubular dies to form a cartridge neck by progressively narrowing the first portion of the vessel from the body diameter at a distal end of the first portion to an open end diameter at the open end to form an empty gas cartridge, wherein the body diameter is greater than a neck diameter.

13 Claims, 16 Drawing Sheets

COMPRESSED GAS CARTRIDGE AND METHOD FOR MAKING SAME

FIELD OF THE INVENTION

The invention is directed to a compressed gas cartridge and a method to form same.

BACKGROUND OF THE INVENTION

Disposable compressed gas cartridges are used in many devices, including bicycle tire inflators, beverage dispensers, and paint ball recreational devices. Prior art methods to form such disposable compressed gas cartridges limit the ratio of body diameters to neck diameters that are available. What is needed is a method to make compressed gas cartridges that facilitates the manufacture of compressed gas cartridges having relatively large cartridge body diameters in combination with relatively small cartridge neck diameters

SUMMARY OF THE INVENTION

A method to form a disposable compressed gas cartridge is presented. The method provides a steel sheet, and using sequentially (N) progressively longer dies forms from the steel sheet a vessel comprising a cylindrical wall, a closed end, and an open end, wherein the cylindrical wall comprises a body diameter, and wherein (N) is greater than equal to 5.

The method then heats a first portion of the vessel at an annealing temperature, wherein that first portion includes the open end and a portion of the cylindrical wall adjacent the open end. The method then uses sequentially (M) tubular dies to form a cartridge neck by progressively narrowing the first portion of the vessel from the body diameter at a distal end of the first portion to an open end diameter at the open end to form an empty gas cartridge, wherein the body diameter is greater than a neck diameter.

A compress gas cartridge is presented. The compressed gas cartridge is formed by the method recited hereinabove. Thereafter, the method drills a distal end of the cartridge neck to clear any residual steel from the open end, fills the empty gas cartridge with a compressed gas, and seals the open end.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

Figure 1:
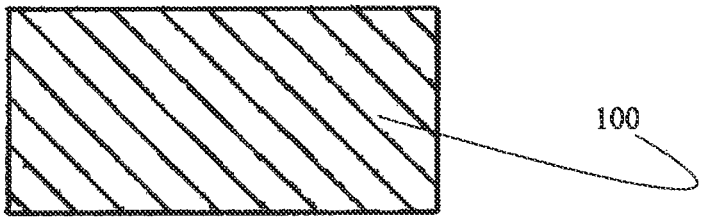
FIG. 1, shows steel slug 100 from which the disposable cartridges of the instant application are formed.

The invention is described in preferred embodiments in the following description with reference to the Figures, in which like numerals represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow charts included are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Applicant's high pressure gas cartridge described and claimed herein are designed for one-time use only. After the compressed gas disposed therein is discharged, the cartridge is discarded. As a result, it is not cost-efficient to equip such disposable cartridges with pressure regulating devices, or over-pressure release valves.

However, the disposable cartridges of the instant application must not explosively release the pressurized contents when exposed to elevated temperatures for prolonged periods of time. As a general matter, the disposable cartridge of this Application will not fail until in internal burst pressure is reached, where that burst pressure if between about 7000 psi to about 8000 psi. Again as a general matter, the cartridge remains in one piece, i.e. no fragments are released, and the seal is not detached during the rupture.

The Assignee hereof utilizes a quality assurance test whereunder representative samples of each manufacturing lot of the high pressure gas cartridges described and claimed in herein are immersed in boiling water for 30 minutes. If any of the tested pressurized cartridges explode, that manufacturing lot is not released for sale in commerce.

Figure 2:
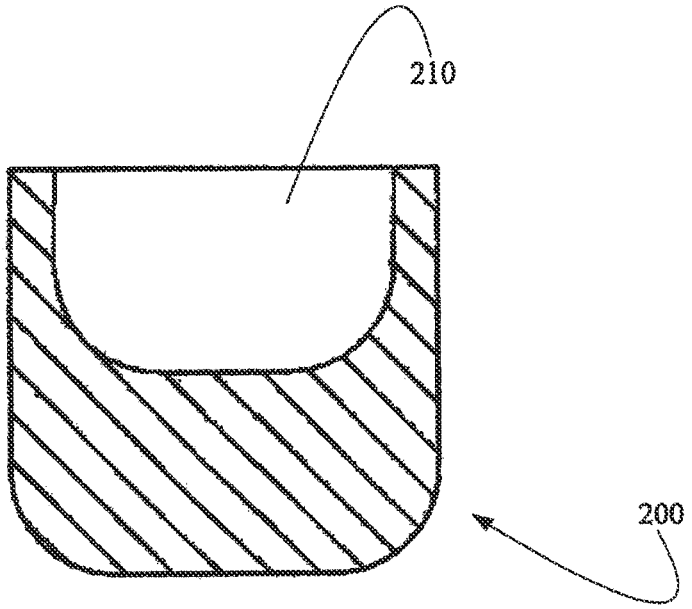
FIG. 2 shows s first die 210 being forced into slug 100 to form intermediate vessel 200.
Figure 3:
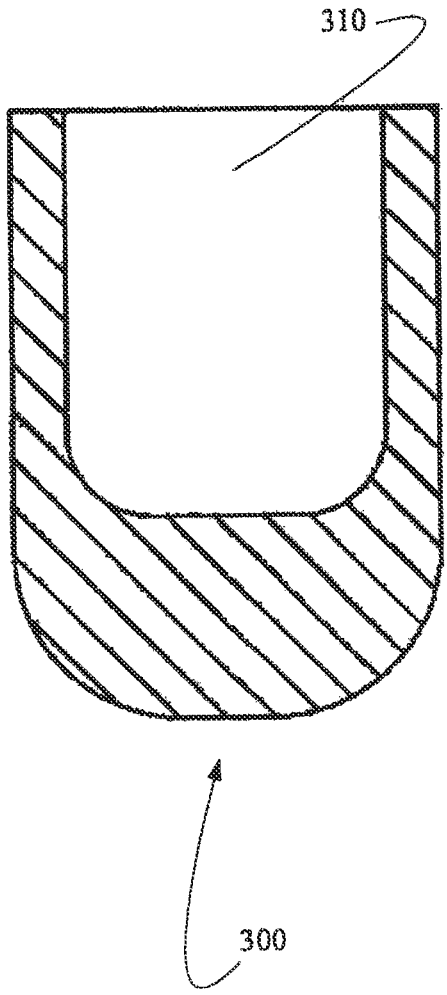
FIGS. 3, 4, and 5A, show progressively longer dies 310, 410, and 510, respectively, being forced into intermediate vessels 200, 300, and 400.
Figure 4:
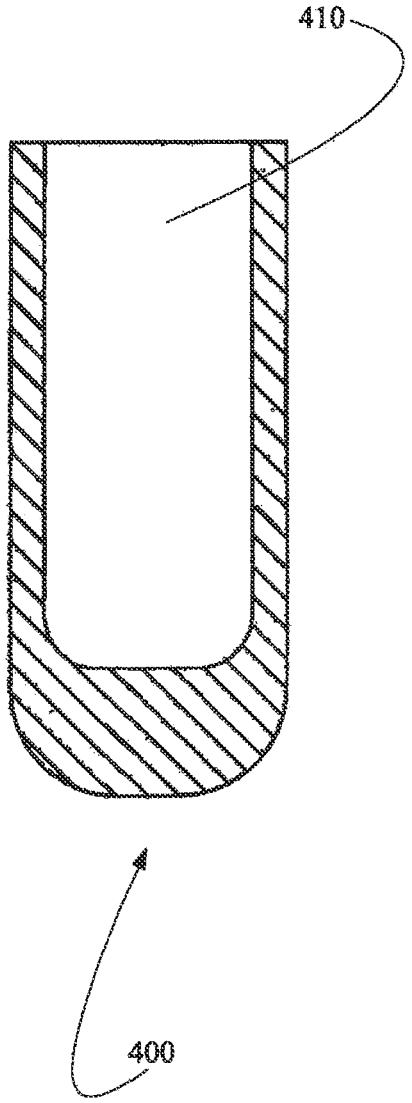
Figure 5A:
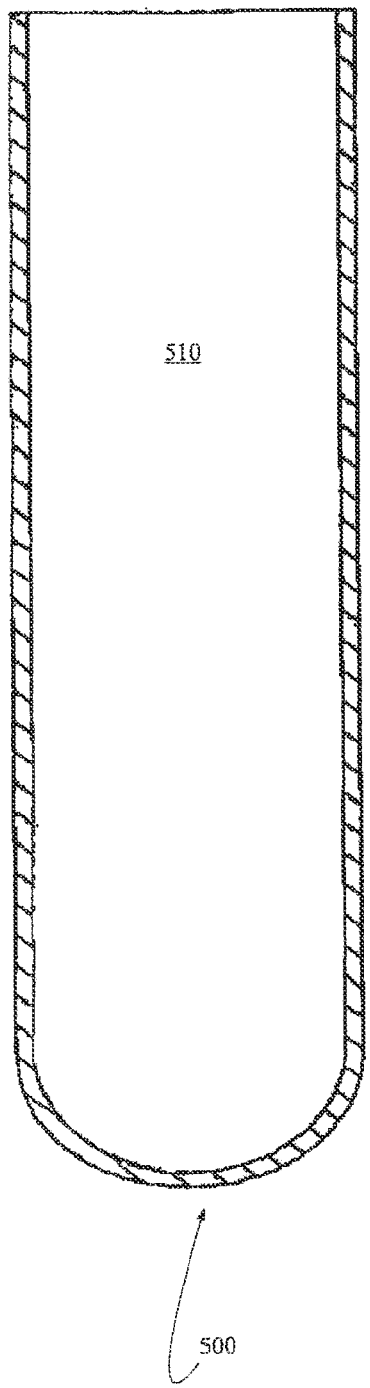

Referring now to FIG. 1, disposable cartridges of the instant application are formed from a steel slug 100. In certain embodiments, steel slug 100 comprises sheet metal. Referring now to FIG. 2, a first die 210 is forced into slug 100 (FIG. 1) to form intermediate vessel 200. Referring now to FIGS. 3, 4, and 5A, progressively longer dies 310, 410, and 510, respectively, are forced into intermediate vessels 200, 300, and 400, respectively, to form intermediate vessels 300, 400, and 500, respectively.

The process shown in FIGS. 2, 3, 4, and 5A, is presented for clarity only, and should not be taken as limiting. In certain embodiments, a total of eight (8) stages, employing a total of 8 dies, are utilized to form a test-tube-like vessel 500 from steel slug 100, wherein that intermediate vessel 500 is further utilized to form Applicant's compressed gas cartridge. In certain embodiments, a total of nine (9) stages, employing a total of 9 dies, are utilized to form a test-tube-like vessel 500 from steel slug 100, wherein that intermediate vessel 500 is further utilized to form Applicant's compressed gas cartridge. In certain embodiments, a total of ten (10) stages, employing a total of 10 dies, are utilized to form a test-tube-like vessel 500 from steel slug 100, wherein that intermediate vessel 500 is further utilized to form Applicant's compressed gas cartridge.

In certain embodiments, the number of stages used to form vessel 500 from slug 100 is determined by the hardness of the steel comprising slug 100. In certain embodiments, the number of stages used to form vessel 500 from slug 100 is determined by the ambient temperature.

Figure 5B:
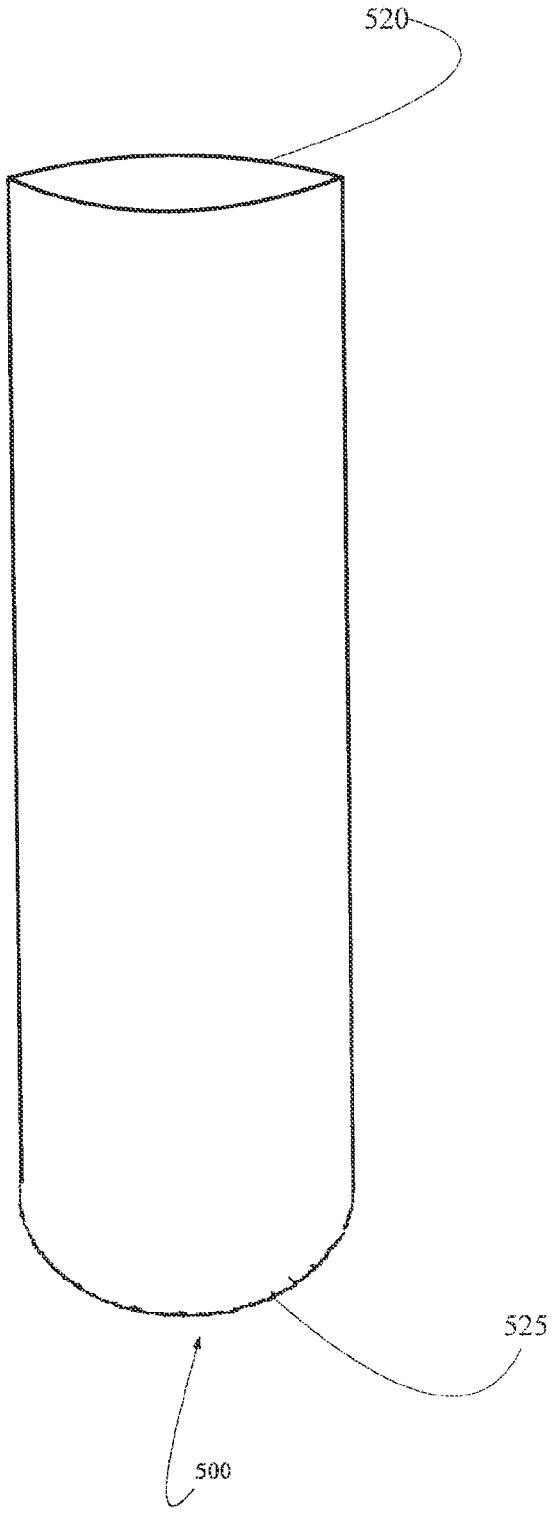
FIG. 5B shows a vessel comprising a closed end, an open end, and a cylindrical wall formed from the steel plate of FIG. 1 using a plurality of dies.
Figure 6A:
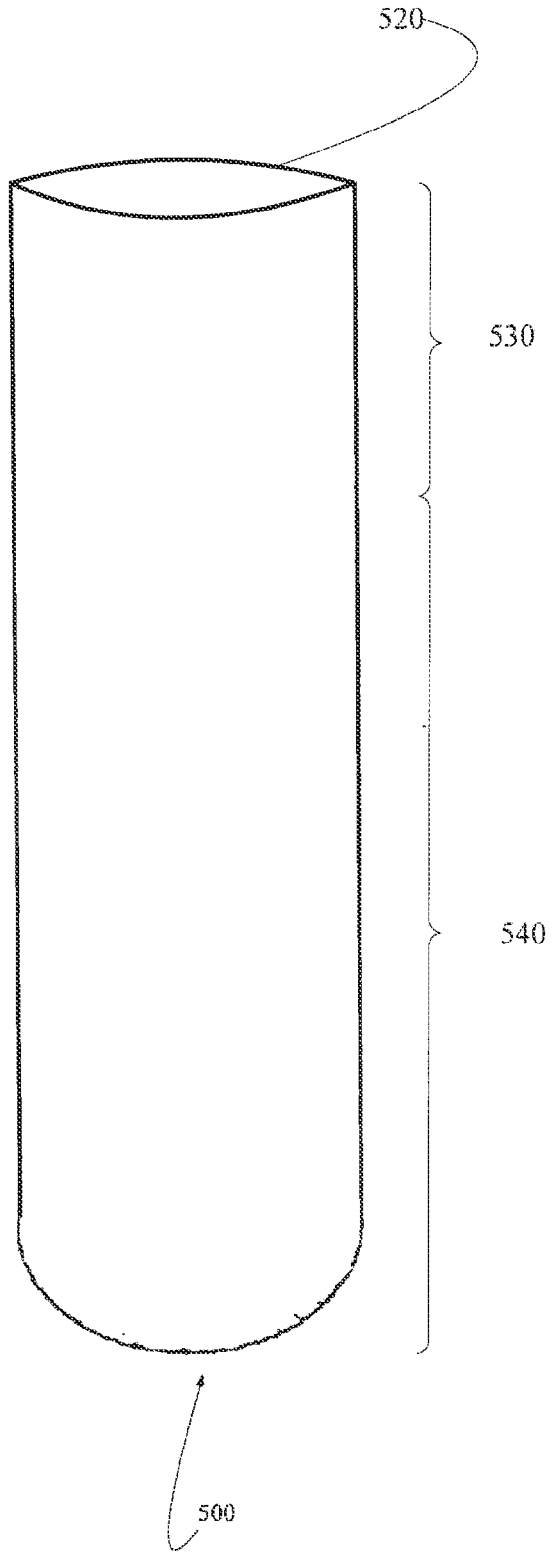
FIG. 6A shows the vessel of FIG. 5 with a first portion and second portion being defined, wherein the first portion will be progressively narrowed to form a neck.

Referring to FIGS. 5B and 6A, intermediate vessel 500 comprises a tubular structure having an open end 520 and a closed end 525. Portion 530 of vessel 500 extends downwardly from open end 520, and will be formed in a tapering neck structure. Portion 540 of vessel 500 extends from the distal end of portion 530 to the bottom of vessel 500, and will comprise the body of Applicant's compressed gas cartridge.

Prior to forming portion 530 into a tapering neck structure, that portion 530 is heated to a temperature of about 700° C. In certain embodiments, the annealing temperature and the annealing time are adjusted based upon ambient temperature.

Applicant uses process annealing to treat vessel 500 prior to forming a tapering neck in portion 530. This allows portion 530 to be soft enough to undergo cold working without fracturing.

Figure 6B:
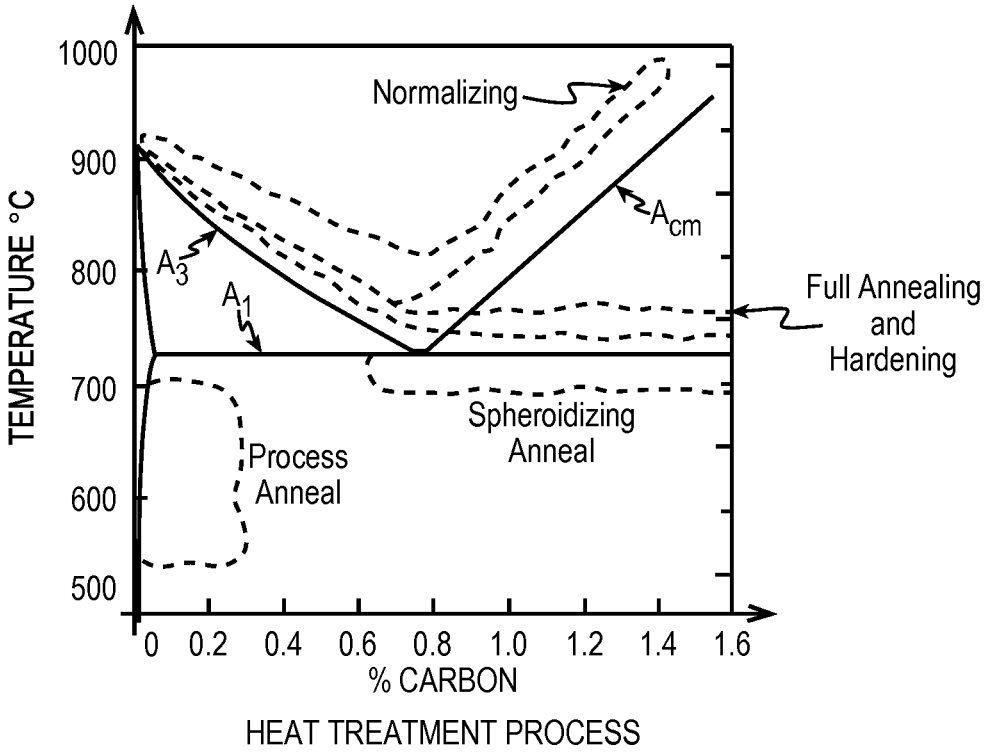
FIG. 6B is a phase diagram showing the phase structure of the steel used to form Applicant's compressed gas cartridge.

Referring now to FIG. 6B, in certain embodiments Applicant heats portion 530 of intermediate vessel 500 to a temperature to just below the Ferrite-Austenite region, line $A_1$ on FIG. 6B. This $A_1$ temperature is about 727° C. (1341° F.), and therefore Applicant heats portion 530 to about 700° C. (1292° F.). This process annealing temperature is held long enough to allow recrystallization of the ferrite phase, and then cooled in still air. Since the material stays in the same phase through out the process, the only change that occurs is the size, shape and distribution of the grain structure.

Figure 7A:
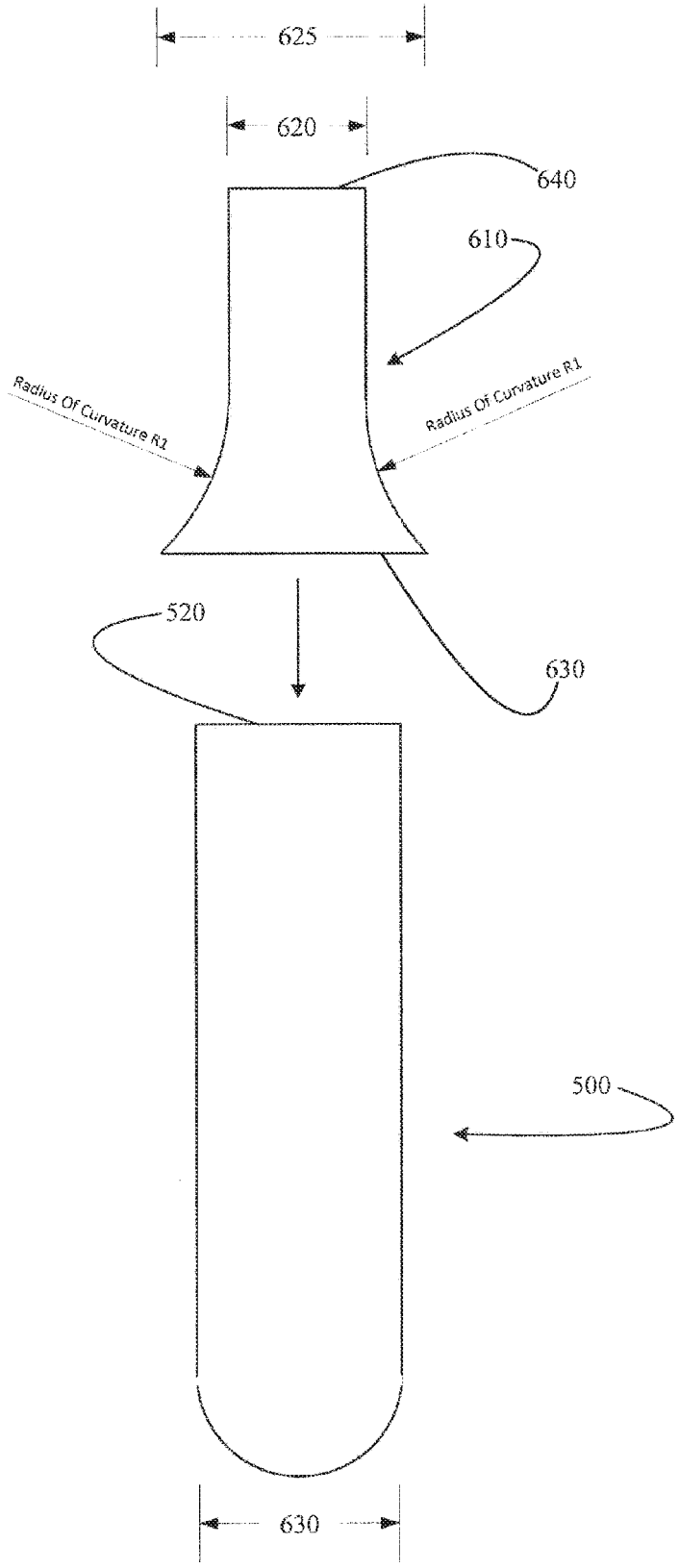
FIG. 7A shows a first tubular die being used to begin the process of narrowing the first portion of the vessel of FIG. 5B into a tapering neck feature.

Referring now to FIG. 7A, intermediate vessel 500 comprises an outer diameter 630. A first stage diameter reduction process utilizes tubular die 610. Tubular die 610 comprises a first end 630 having a first interior diameter 625, a second end 640 having a second interior diameter 620, wherein interior diameter 620 is less than both interior diameter 625 and outer diameter 630, and a truncated cone section comprising a radius of curvature R1 transitioning from the first interior diameter 625 to the second interior diameter 620.

Figure 7B:
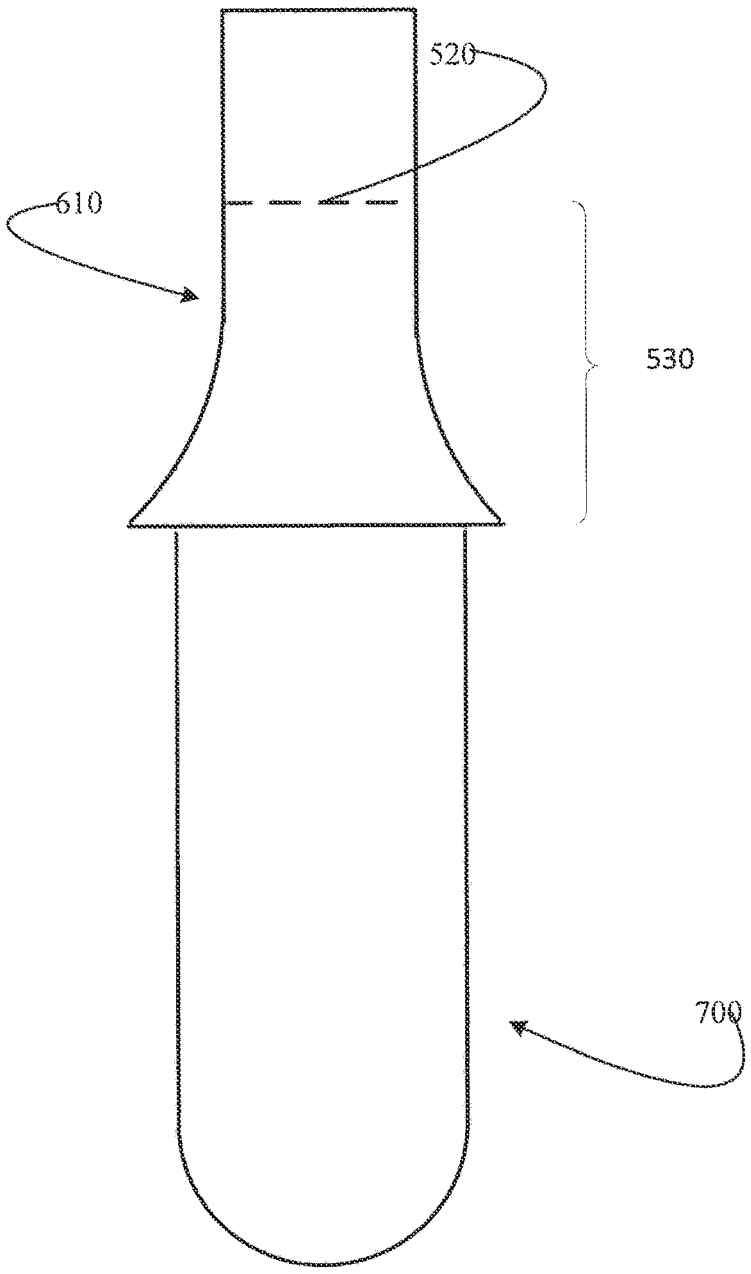
FIG. 7B illustrates the tubular die of FIG. 7A being used to form a first neck portion.
Figure 8:
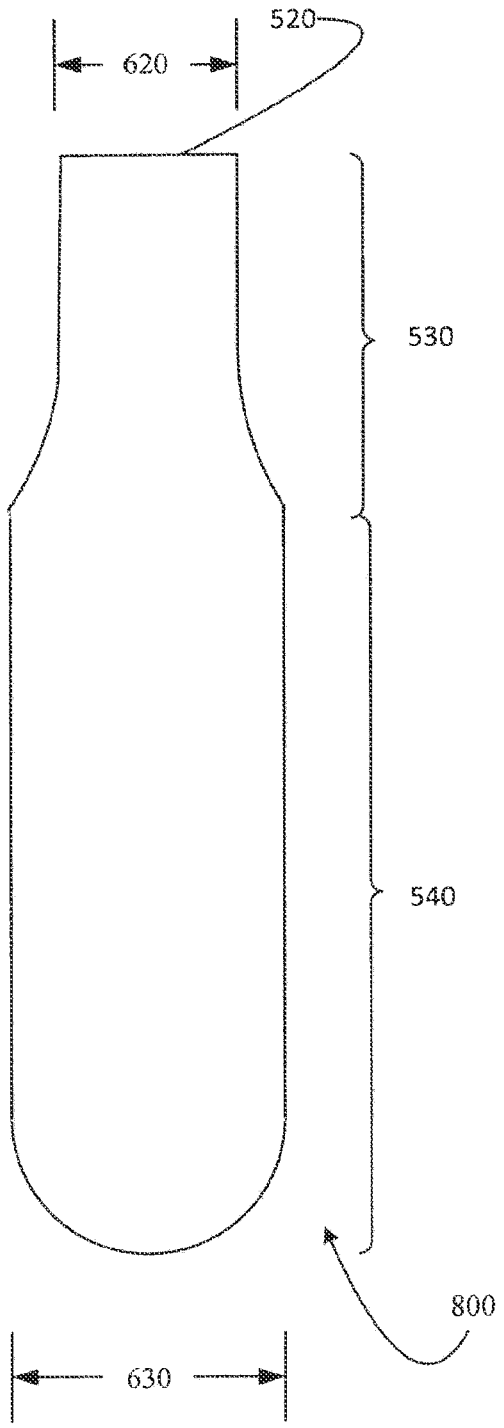
FIG. 8 illustrates a first neck portion.

Referring now to FIG. 7B, top end 520 of vessel 500 is inserted into tubular die 610 thereby reducing the outer diameter of a portion of neck 530 to the interior diameter 620. Referring now to FIG. 8, new vessel 800 comprises a body portion 540 having an outer diameter 630 wherein a portion of neck comprises an outer diameter 620.

Figure 9:
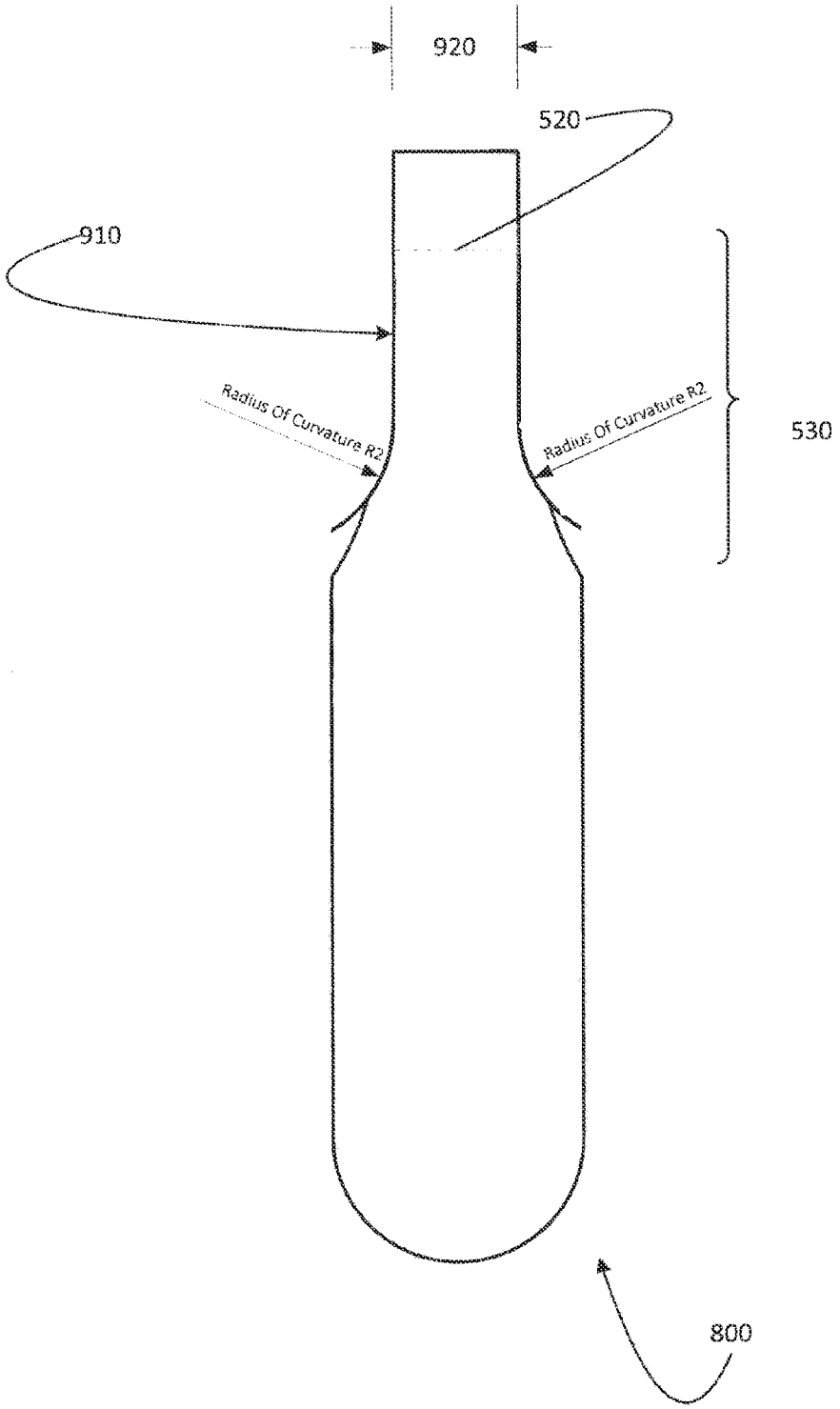
FIG. 9 illustrates a second tubular die being used to further narrow the diameter of the neck portion.

A second stage diameter reduction process utilizes a second tubular die 910. Referring to FIG. 9, top end 520 of vessel 800 is inserted into tubular die 910 having an interior diameter 920, thereby reducing the outer diameter of a portion of neck 530 to the interior diameter 920, wherein interior diameter 920 is less than interior diameter 620. Tubular die 910 comprises a second radius of curvature. In certain embodiments, the second radius of curvature of tubular die 910 is less than the first radius of curvature of tubular die 610. In certain embodiments, the second radius of curvature of tubular die 910 is greater than the first radius of curvature of tubular die 610. In certain embodiments, the second radius of curvature of tubular die 910 is substantially equal to the first radius of curvature of tubular die 610.

Figure 10:
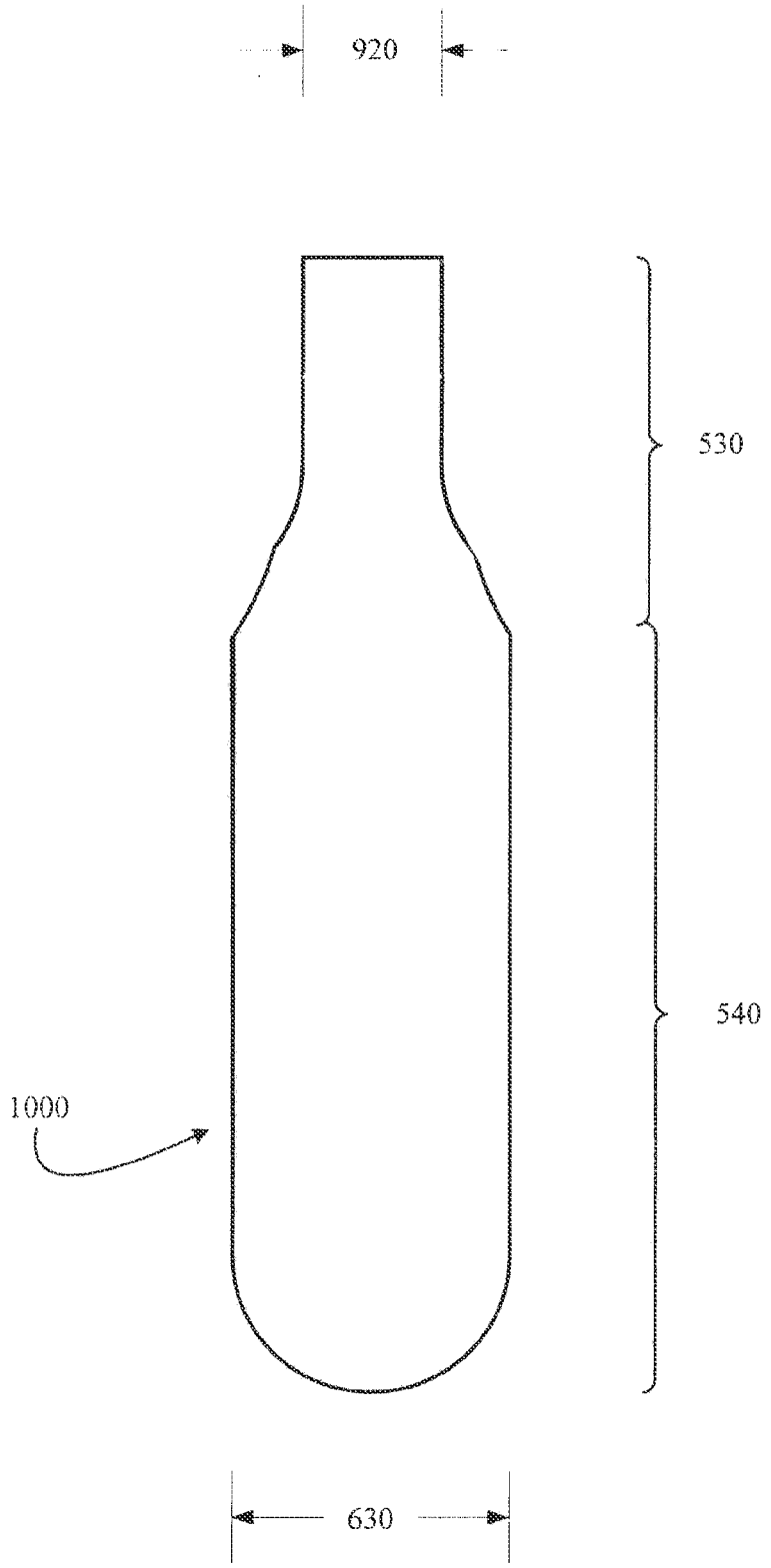
FIG. 10 shows a two stage reduction in the diameter of the neck portion of Applicant's compressed gas cartridge.
Figure 11:
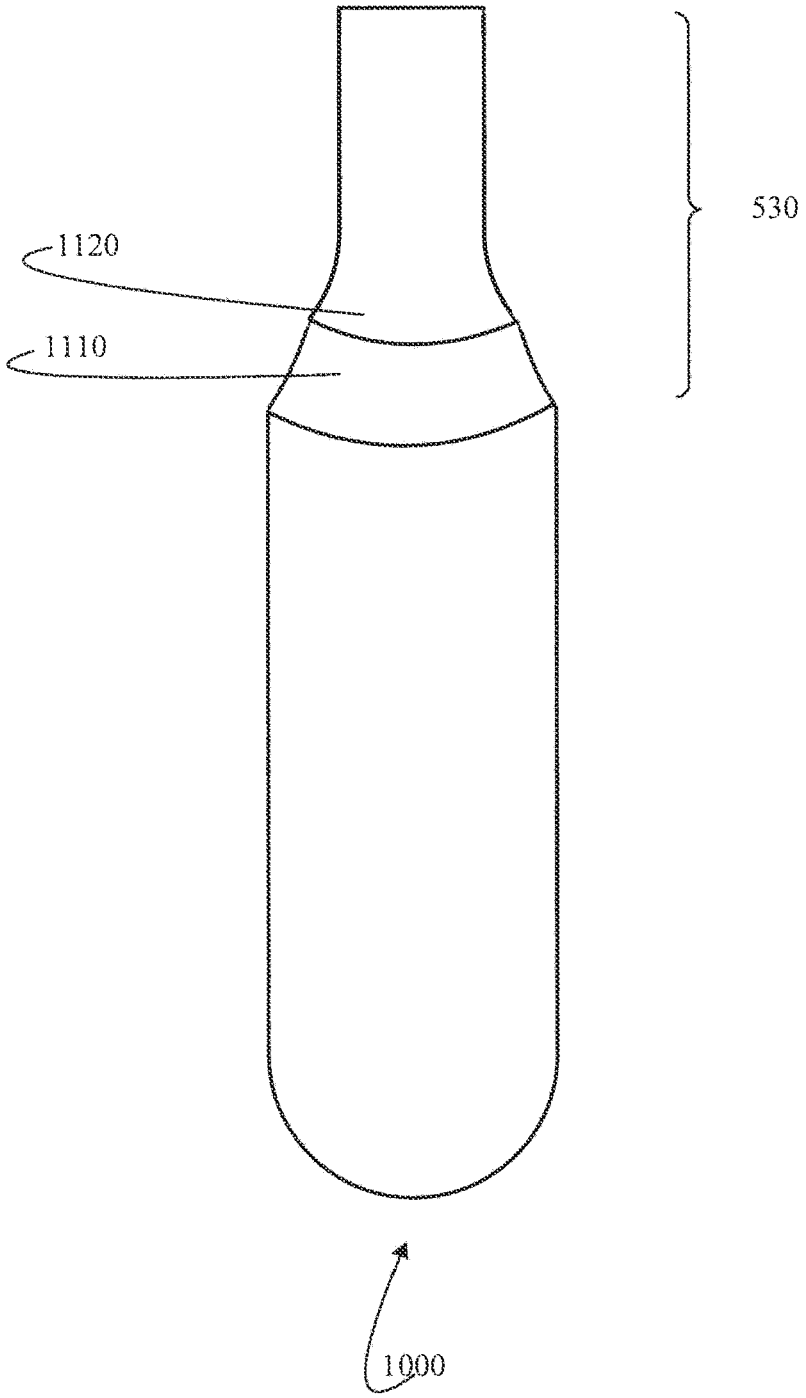
FIG. 11 shows the two stage reduction of FIG. 10.

Referring now to FIG. 10, new vessel 1000 comprises a body portion 540 having an outer diameter 630 and a neck portion 530 having an outer diameter 920. Referring now to FIG. 11, a portion of neck 530 has undergone a two stage reduction in the outside diameter. The first stage diameter reduction, performed using tubular die 610 comprising a first radius of curvature, formed portion 1110. The second stage diameter reduction, performed using tubular die 910 comprising a second radius of curvature, formed portion 1120. As those skilled in the art will appreciate, the sizes of portions 1110 and 1120 are greatly enlarged for clarity.

Figure 12:
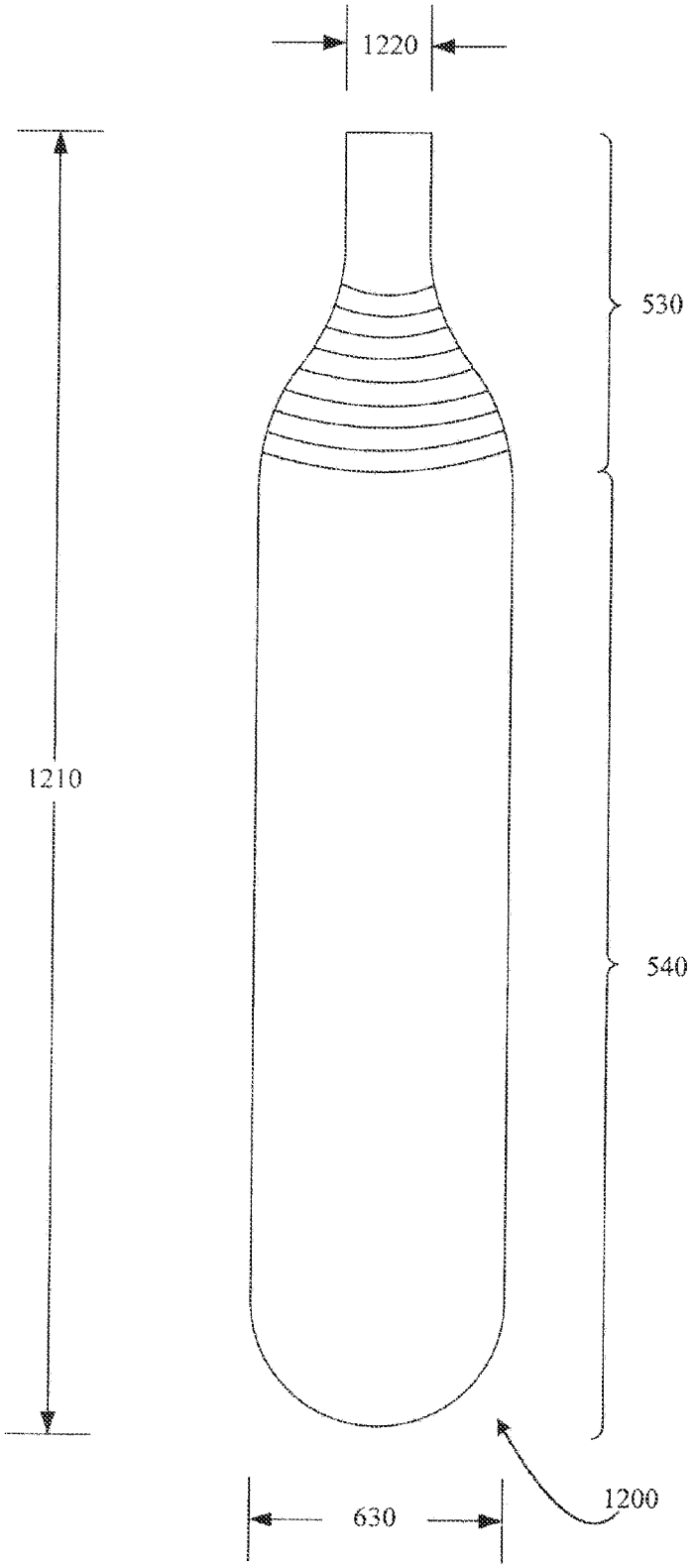
FIG. 12 illustrates a nine stage reduction of the neck portion to form an open end having an outer diameter 1220 wherein the body portion comprises an outer diameter 630.

Referring now to FIG. 12, in certain embodiments, Applicant uses a nine stage diameter reduction process to form compressed gas cartridge 1200. Compressed gas cartridge 1200 comprises a length 1210, a neck outer diameter 1220, and a body outer diameter 630. In certain embodiments, length 1210 is about 100 mm, neck outer diameter 1220 is about 8.7 mm, and body outer diameter is about 21.4 mm. In certain embodiments, length 1210 is about 100 mm, neck outer diameter 1220 is about 8.3 mm, and body outer diameter is about 21.4 mm. In certain embodiments, length 1210 is about 100 mm, neck outer diameter 1220 is about 7.6 mm, and body outer diameter is about 25.4 mm.

Figure 13:
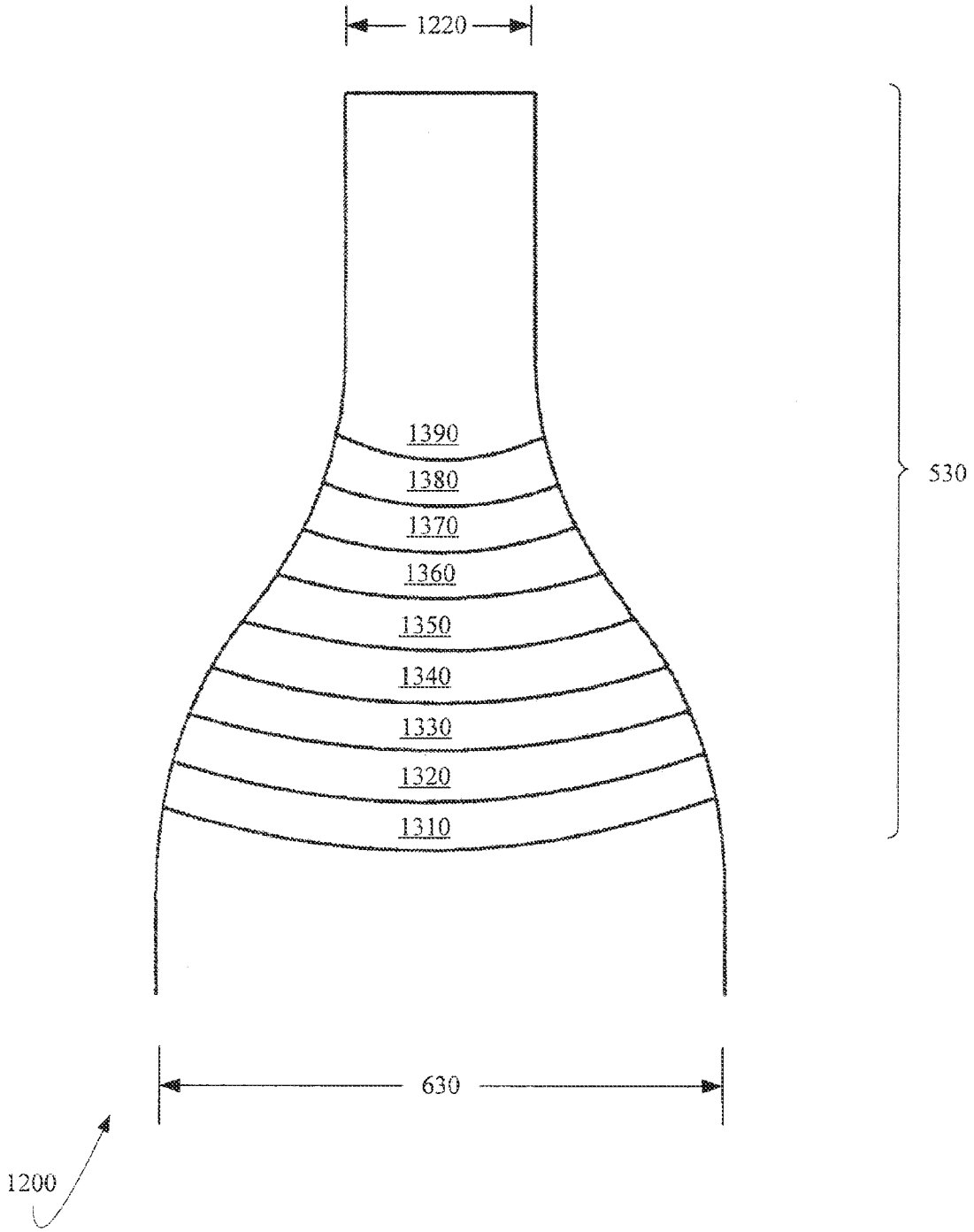
FIG. 13 shows an enlarged view of the nine stage neck reduction of FIG. 12.

FIG. 13 shows neck portion 530 of Applicant's compressed gas cartridge 1200 formed using Applicant's nine stage diameter reduction process. A first stage diameter reduction process was performed using a first tubular die comprising a first radius of curvature to form neck portion 1310. A second stage diameter reduction process was performed using a second tubular die comprising a second radius of curvature to form neck portion 1320. A third stage diameter reduction process was performed using a third fibular die comprising a third radius of curvature to form neck portion 1330. A fourth stage diameter reduction process was performed using a fourth tubular die comprising a fourth radius of curvature to form neck portion 1340.

A fifth stage diameter reduction process was performed using a fifth tubular die comprising a fifth radius of curvature to form neck portion 1350. A sixth stage diameter reduction process was performed using a sixth tubular die comprising a sixth radius of curvature to form neck portion 1360. A seventh stage diameter reduction process was performed using a seventh tubular die comprising a seventh radius of curvature to form neck portion 1370. An eighth stage diameter reduction process was performed using an eighth tubular die comprising an eighth radius of curvature to form neck portion 1380. A ninth stage diameter reduction process was performed using a ninth tubular die comprising a ninth radius of curvature to form neck portion 1390.

Depending on the ratio of diameter 1220 to diameter 630, thinning can occur in neck portions 1360, and/or 1370, and/or 1380, and/or 1390. Such thinning could compromise the structural integrity of compressed gas cartridge 1200 when filled with a compressed gas.

In these embodiments and to reduce thinning in the wall thickness of neck portions 1360, and/or 1370, and/or 1380, and/or 1390, the sixth radius of curvature, and/or the seventh radius of curvature, and/or the eighth radius of curvature, and/or the ninth radius of curvature, are less than any of the first radius of curvature, the second radius of curvature, the third radius of curvature, the fourth radius of curvature, and the fifth radius of curvature.

In certain embodiments, after forming compressed gas cartridge 1200 as described herein above, the distal neck portion is drilled to clear any residual steel from the aperture, and cut to assure a flat surface. Thereafter, compressed gas cartridge 1200 is filled with liquid carbon dioxide. Compressed gas cartridge 1200 comprises an interior volume. In certain embodiments, compressed gas cartridge 1200 is filled with an amount of liquid carbon dioxide equal to about 0.70 times the interior volume. In certain embodiments, compressed gas cartridge 1200 is filled with an amount of liquid carbon dioxide equal to about 0.75 times the interior volume. In certain embodiments, compressed gas cartridge 1200 is filled with an amount of liquid carbon dioxide equal to about 0.80 times the interior volume.

After being filled with liquid carbon dioxide, the filled compressed gas cartridge 1200 is sealed. In certain embodiments, a plug-type seal is employed wherein that seal plugs the inner aperture but does not extend outwardly therefrom. In certain embodiments, an overcap seal is employed, wherein that seal comprises a cap that covers the entire end of compressed gas cartridge 1200.

The described features, structures, or characteristics of the invention may be combined in any suitable manner in one or more embodiments. In the above description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention. In other words, the present invention may be embodied in other specific forms without departing from its spirit or essential characteristics. The described implementations are to be considered in all respects only as illustrative and not restrictive. The scope of the invention should, therefore, be determined not with reference to the above description, but instead should be determined with reference to the pending claims along with their full scope or equivalents, and all changes which come within the meaning and range of equivalency of the claims are to be embraced within their full scope.

I claim:

1. A method to form a disposable compressed gas cartridge, comprising:

providing a steel sheet;

using sequentially (N) progressively longer dies to form from said steel sheet a vessel comprising a cylindrical wall, a closed end, and an open end, wherein said cylindrical wall comprises a body diameter, and wherein (N) is greater than or equal to 5;

prior to forming a tapering neck structure, heating a first portion of said vessel at an annealing temperature of about 700° C. to recrystallize a ferrite phase followed by cooling in still air, wherein said first portion includes said open end and a portion of said cylindrical wall adjacent said open end, and wherein said vessel excluding said first portion is not heated to said annealing temperature;

using sequentially (M) tubular dies to form a cartridge neck by progressively narrowing said first portion of said vessel from said body diameter at a distal end of said first portion to an open end diameter at said open end to form an empty gas cartridge, wherein said body diameter is greater than said neck diameter.

2. The method of claim 1, wherein:

said steel sheet comprises a Ferrite-Austenite region at temperature of about 727° C. or greater; and said annealing temperature is less than 727° C.

3. The method of claim 1, wherein (N) is 8.

4. The method of claim 1, wherein (N) is 9.

5. The method of claim 1, wherein (N) is 10.

6. The method of claim 1, wherein (M) is 8.

7. The method of claim 1, wherein (M) is 10.

8. The method of claim 1, wherein (M) is 9.

9. The method of claim 8, wherein each of said (M) tubular dies comprises a first end having a first interior diameter, a second end having a second interior diameter, and a truncated cone section comprising a radius of curvature transitioning from said first interior diameter to said second interior diameter, wherein said first interior diameter is less than both said second interior diameter and body diameter.

10. The method of claim 1, further comprising:

drilling a distal end of said cartridge neck to clear any residual steel from said open end;

filling said empty gas cartridge with a compressed gas; and sealing said open end.

11. The method of claim 10, wherein said empty gas cartridge comprises an interior volume, and wherein said filling step comprises filling said empty gas cartridge with an amount of liquid carbon dioxide equal to between about 0.70 times said interior volume and 0.80 times said interior volume.

12. The method of claim 10, wherein said length is about 100 mm, said outer body diameter is about 21.4 mm, and said outer neck diameter is about 8.3 mm.

13. The method of claim 10, wherein said length is about 100 mm, said outer body diameter is about 25.4 mm, and said outer neck diameter is about 7.6 mm.

* * * * *